US009663995B2

(12) United States Patent
Jain

(10) Patent No.: US 9,663,995 B2
(45) Date of Patent: May 30, 2017

(54) DRILL BIT WITH SELF-ADJUSTING GAGE PADS

(71) Applicant: Jayesh R. Jain, The Woodlands, TX (US)

(72) Inventor: Jayesh R. Jain, The Woodlands, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 266 days.

(21) Appl. No.: 14/516,069

(22) Filed: Oct. 16, 2014

(65) Prior Publication Data

US 2016/0032658 A1 Feb. 4, 2016

Related U.S. Application Data

(63) Continuation-in-part of application No. 13/864,926, filed on Apr. 17, 2013, now Pat. No. 9,255,450.

(51) Int. Cl.
*E21B 10/62* (2006.01)
*E21B 17/10* (2006.01)

(52) U.S. Cl.
CPC ..... *E21B 10/62* (2013.01); *E21B 17/1014* (2013.01); *E21B 17/1092* (2013.01)

(58) Field of Classification Search
CPC .... E21B 10/62; E21B 10/54; E21B 2010/622; E21B 7/064
See application file for complete search history.

(56) References Cited

U.S. PATENT DOCUMENTS 1,612,338 A * 12/1926 Wilson ..... E21B 4/16 173/15
3,050,122 A * 8/1962 Huitt ..... E21B 10/322 166/55.8
3,422,672 A 1/1969 Payne
3,583,501 A 6/1971 Aalund
4,386,669 A 6/1983 Evans
4,856,601 A 8/1989 Raney
5,553,678 A 9/1996 Barr et al.
6,142,250 A 11/2000 Griffin et al.
7,971,662 B2 7/2011 Beuershausen
8,061,455 B2 11/2011 Beuershausen
(Continued)

OTHER PUBLICATIONS

International Search Report and Written Opinion for PCT/US2014/034493; International Filing Date Apr. 17, 2014; Mail date Aug. 20, 2014; (16 pages).

(Continued)

*Primary Examiner* — Jennifer H Gay
(74) *Attorney, Agent, or Firm* — Cantor Colburn LLP

(57) ABSTRACT

A drill bit and a method of drilling a wellbore utilizing the drill bit is disclosed. The method includes providing a drill bit including a bit body and at least one movable member associated with a lateral extent of the bit body. The method further includes conveying a drill string into a formation, the drill string having the drill bit at the end thereof and drilling the wellbore using the drill string. During drilling, the drill bit can selectively extend the at least one moveable member from the lateral extent of the bit body at a first rate and selectively retract the at least one moveable member to a retracted position at a second rate that is less than the first rate.

26 Claims, 3 Drawing Sheets

(56) References Cited

U.S. PATENT DOCUMENTS

| | | | | |
|---|---|---|---|---|
| 8,205,686 | B2 * | 6/2012 | Beuershausen | E21B 10/62 175/408 |
| 8,763,726 | B2 | 7/2014 | Johnson et al. | |
| 9,255,450 | B2 * | 2/2016 | Jain | E21B 10/62 |
| 2007/0221416 | A1 | 9/2007 | Hall et al. | |
| 2007/0272445 | A1 | 11/2007 | Cariveau | |
| 2008/0000693 | A1 | 1/2008 | Hutton | |
| 2009/0044979 | A1 | 2/2009 | Johnson | |
| 2009/0107722 | A1 | 4/2009 | Chen et al. | |
| 2010/0071956 | A1 | 3/2010 | Beuershausen | |
| 2010/0212964 | A1 | 8/2010 | Beuershausen | |
| 2012/0255788 | A1 | 10/2012 | Schwefe | |
| 2013/0025358 | A1 | 1/2013 | Radford et al. | |
| 2014/0311801 | A1 | 10/2014 | Jain et al. | |
| 2015/0191979 | A1 * | 7/2015 | Jain | E21B 10/54 175/57 |
| 2016/0032658 | A1 * | 2/2016 | Jain | E21B 10/62 175/27 |

OTHER PUBLICATIONS

Jain, Jayesh R., et al.: "Mitigation of Torsional Stick-Slip Vibrations in Oil Well Drilling through PDC Bit Design: Putting Theories to the Test," SPE 146561, SPE Annual Technical Conference and Exhibition, Denver, Colorado, Oct. 30-Nov. 2, 2011. (14 pages).

* cited by examiner

DRILL BIT WITH SELF-ADJUSTING GAGE PADS

CROSS-REFERENCE TO RELATED APPLICATIONS

This patent application is a Continuation-In-Part Application of U.S. Non-Provisional patent application Ser. No. 13/864,926, filed Apr. 17, 2013 which is incorporated herein by reference in its entirety.

BACKGROUND INFORMATION

1. Field of the Disclosure

This disclosure relates generally to drill bits and systems that utilize the same for drilling wellbores.

2. Background of the Art

Oil wells (also referred to as "wellbores" or "boreholes") are drilled with a drill string that includes a tubular member having a drilling assembly (also referred to as the "bottom-hole assembly" or "BHA") at the bottom end of the tubular. The BHA typically includes devices and sensors that provide information relating to a variety of parameters relating to the drilling operations ("drilling parameters"), behavior of the BHA ("BHA parameters") and parameters relating to the formation surrounding the wellbore ("formation parameters"). A drill bit attached to the bottom end of the BHA is rotated by rotating the drill string and/or by a drilling motor (also referred to as a "mud motor") in the BHA to disintegrate the rock formation to drill the wellbore. A large number of wellbores are drilled along contoured trajectories. For example, a single wellbore may include one or more vertical sections, deviated sections, curved sections and horizontal sections through differing types of rock formations. Drilling conditions differ based on the wellbore contour, rock formation and wellbore depth. During most drilling conditions, it is desired to maintain low frictional torque and increased steerability. However, when lateral vibrations such as backward whirl occur, it is desired to minimize such lateral vibrations. Often drill bit gage pads are designed with a gage extension to provide a compromise between low frictional torque and minimizing lateral vibrations. Accordingly, it is desired to have a drill bit with self-adjusting gage pads to provide low frictional torque and increased steerability while minimizing lateral vibrations.

The disclosure herein provides a drill bit and drilling systems using the same that includes self adjusting gage pads.

SUMMARY

In one aspect, a drill bit is disclosed, including: a bit body; and at least one moveable member associated with a lateral extent of the bit body that extends from the lateral extent of the bit body at a first rate and retracts from an extended position to a retracted position at a second rate that is less than the first rate.

In another aspect, a method of drilling a wellbore is disclosed, including: providing a drill bit including a bit body and at least one movable member associated with a lateral extent of the bit body; conveying a drill string into a formation, the drill string having the drill bit at the end thereof; drilling the wellbore using the drill string; selectively extending the at least one moveable member from the lateral extent of the bit body at a first rate; and selectively retracting the at least one moveable member to a retracted position at a second rate that is less than the first rate.

In another aspect, a system for drilling a wellbore is disclosed, including: a drilling assembly having a drill bit, the drill bit including: a bit body; and at least one moveable member associated with a lateral extent of the bit body that extends from the lateral extent of the bit body at a first rate and retracts from an extended position to a retracted position at a second rate that is less than the first rate.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DESCRIPTION OF THE EMBODIMENTS

Figure 1:
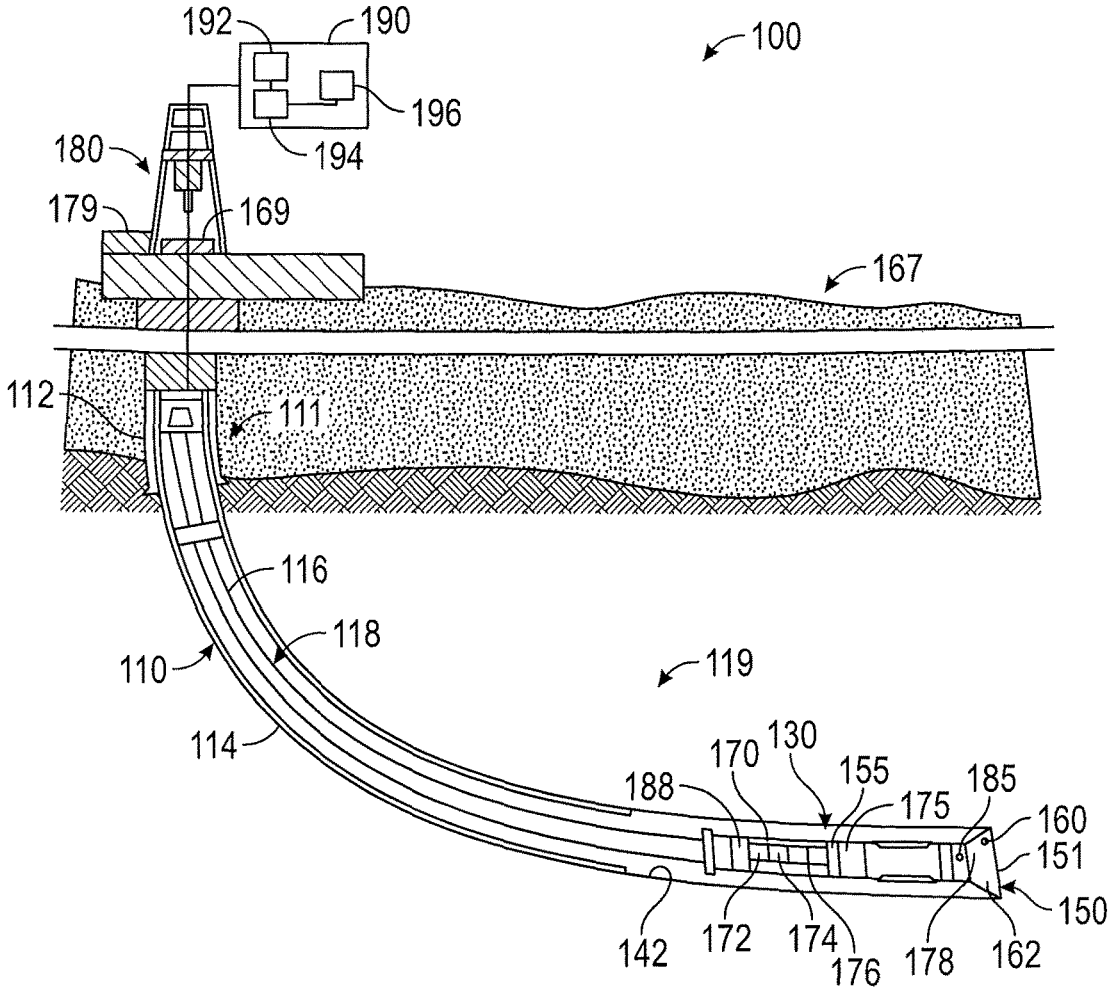
FIG. 1 is a schematic diagram of an exemplary drilling system that includes a drill string that has a drill bit made according to one embodiment of the disclosure.

FIG. 1 is a schematic diagram of an exemplary drilling system 100 that may utilize drill bits made according to the disclosure herein. FIG. 1 shows a wellbore 110 having an upper section 111 with a casing 112 installed therein and a lower section 114 being drilled with a drill string 118. The drill string 118 is shown to include a tubular member 116 with a BHA 130 attached at its bottom end. The tubular member 116 may be made up by joining drill pipe sections or it may be a coiled-tubing. A drill bit 150 is shown attached to the bottom end of the BHA 130 for disintegrating the rock formation 119 to drill the wellbore 110 of a selected diameter.

Drill string 118 is shown conveyed into the wellbore 110 from a rig 180 at the surface 167. The exemplary rig 180 shown is a land rig for ease of explanation. The apparatus and methods disclosed herein may also be utilized with an offshore rig used for drilling wellbores under water. A rotary table 169 or a top drive (not shown) coupled to the drill string 118 may be utilized to rotate the drill string 118 to rotate the BHA 130 and thus the drill bit 150 to drill the wellbore 110. A drilling motor 155 (also referred to as the "mud motor") may be provided in the BHA 130 to rotate the drill bit 150. The drilling motor 155 may be used alone to rotate the drill bit 150 or to superimpose the rotation of the drill bit 150 by the drill string 118. A control unit (or controller) 190, which may be a computer-based unit, may be placed at the surface 167 to receive and process data transmitted by the sensors in the drill bit 150 and the sensors in the BHA 130, and to control selected operations of the various devices and sensors in the BHA 130. The surface controller 190, in one embodiment, may include a processor 192, a data storage device (or a computer-readable medium) 194 for storing data, algorithms and computer programs 196. The data storage device 194 may be any suitable device, including, but not limited to, a read-only memory (ROM), a random-access memory (RAM), a flash memory, a magnetic tape, a hard disk and an optical disk. During drilling, a drilling fluid 179 from a source thereof is pumped under pressure into the tubular member 116. The drilling fluid discharges at the bottom of the drill bit 150 and returns to the surface via the annular space (also referred as the "annulus") between the drill string 118 and the inside wall 142 of the wellbore 110.

Still referring to FIG. 1, the drill bit 150 includes a face section (or bottom section) 151. The face section 151 or a portion thereof faces the formation in front of the drill bit or the wellbore bottom during drilling. The drill bit 150, in one aspect, includes one or more adjustable members or pads 160 along the longitudinal side 162 of the drill bit 150. The members 160 are "extensible members" or "adjustable members". A suitable actuation device (or actuation unit) 155 in the BHA 130 or a device 185 in the drill bit 150 or a combination thereof may be utilized to activate the members 160 during drilling of the wellbore 110. In an exemplary embodiment, the actuation device 155 is also referred to as a "rate control device" or "rate controller." In another aspect, the actuation device 155 is a passive device that automatically adjusts or self-adjusts the extension and retraction of the pad 160 based on or in response to the force or pressure applied to the member 160 during drilling. The rate of extension and retraction of the pad may be preset as described in more detail in reference to FIGS. 2-4. In an exemplary embodiment, signals corresponding to the extension of the members 160 may be provided by one or more suitable sensors 178 associated with the members 160 or associated with the actuation units 155 or 185.

The BHA 130 may further include one or more downhole sensors (collectively designated by numeral 175). The sensors 175 may include any number and type of sensors, including, but not limited to, sensors generally known as the measurement-while-drilling (MWD) sensors or the logging-while-drilling (LWD) sensors, and sensors that provide information relating to the behavior of the BHA 130, such as drill bit rotation (revolutions per minute or "RPM"), tool face, pressure, vibration, whirl, bending, and stick-slip. The BHA 130 may further include a control unit (or controller) 170 configured to control the operation of the members 160 and for at least partially processing data received from the sensors 175 and 178. The controller 170 may include, among other things, circuits to process the sensor 175 and 178 signals (e.g., amplify and digitize the signals), a processor 172 (such as a microprocessor) to process the digitized signals, a data storage device 174 (such as a solid-state-memory), and a computer program 176. The processor 172 may process the digitized signals, process data from other sensors downhole, control other downhole devices and sensors, and communicate data information with the controller 190 via a two-way telemetry unit 188. In an exemplary embodiment, members 160 are extended and retracted autonomously via rate control devices 170.

In an exemplary embodiment, gage pads 160 are extended relative to the drill bit 150 to act as a stabilizer, which can effectively reduce vibration, whirl, stick-slip, etc. Reduction in these attributes can increase borehole quality. Similarly, in an exemplary embodiment, gage pads 160 are retracted to decrease friction, increase deflection, maneuverability and borehole quality when vibrations are not experienced. For example, referring to FIG. 2, retracted gage pads 260 allow for bit 200 to deviate axis 202 from a borehole axis a greater amount, then when gage pads 260 are extended, allowing for greater steerability. Advantageously, the use of rate control devices 155 allow adjustable gage pads 160 to self-adjust the relative extension thereof (undergage/overgage relative to the cutters of the drill bit) allowing for enhanced performance and borehole quality in a greater variety of situations.

Figure 2:
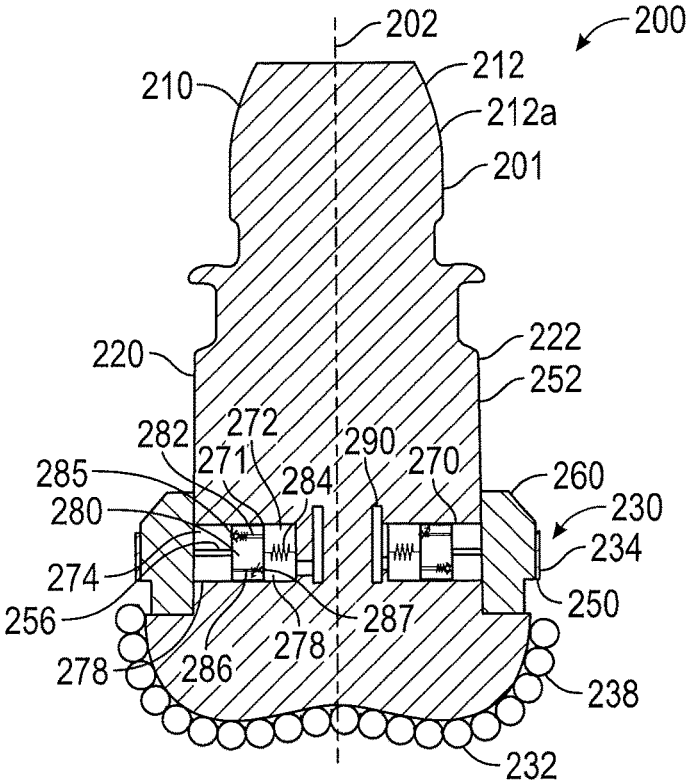
FIG. 2 shows a cross sectional view of an exemplary drill bit with a moveable member on a bit body actuated by a rate control device, according to one embodiment of the disclosure.

FIG. 2 shows an exemplary drill bit 200 made according to one embodiment of the disclosure. The drill bit 200 is a bit having a bit body 201 that includes a pin or pin section 210, a shank 220, a crown or crown section 230, rate control device 270 and moveable members 260. In an exemplary embodiment, the drill bit 200 is any suitable bit, including, but not limited to roller cone, hybrid, and polycrystalline diamond compact (PDC).

In an exemplary embodiment, the pin 210 has a tapered threaded upper end 212 having threads 212*a* thereon for connecting the drill bit 200 to a box end of the drilling assembly 130 (FIG. 1). The shank 220 has a lower vertical or straight section 222. The crown 230 includes a face or face section 232 that faces the formation during drilling.

In an exemplary embodiment, crown 230 includes cutters 238 on face section 232 as well as lateral extents of crown 230. Such cutters 238 allow for removal of material in the formation.

In an exemplary embodiment, the lateral extents of bit body 201 include static gage pads 234. Static gage pads 234 may be provided to combat stick slip, vibration, and whirl, and increase borehole quality. As previously contemplated, the optimal extension of a gage pad depends on operating conditions and if vertical, horizontal deviated or curved wellbore path is desired. In certain conditions, an extended gage pad is desired for drill bit stability, while a retracted gage pad is desired for decreased friction and increased steering capability. As previously contemplated, for wellbores wherein deviated, curved and non-deviated portions are required or desired, a static gage pad may be optimized for a certain set of parameters and characteristics. In certain embodiments, static gage pads 234 may be utilized with the movable members 260 discussed herein.

Figure 2A:
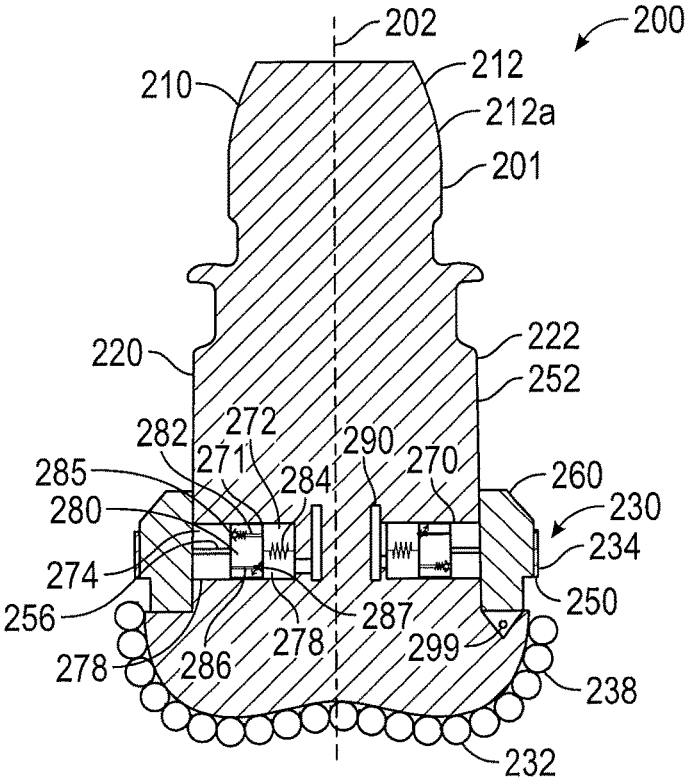
FIG. 2A shows a cross sectional view of another exemplary drill bit with a moveable member on a bit body actuated by a rate control device, according to one embodiment of the disclosure.
Figure 2B:
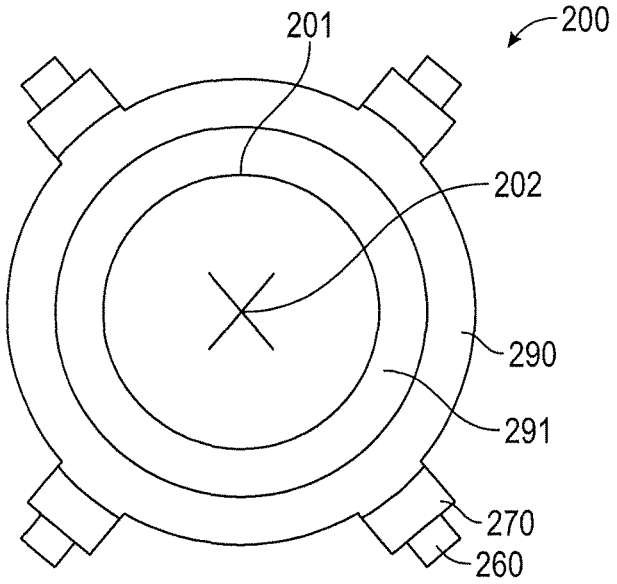
FIG. 2B shows a partial plan view of an embodiment of a sleeve for use with a drill bit, such as the drill bits shown in FIG. 2 and FIG. 2A.

In an exemplary embodiment, the drill bit 200 may further include one or more movable members (moveable gage pads) 260 that extend and retract. In other embodiments, moveable gage pads 260 can be utilized on any suitable downhole equipment, such as drill bits, stabilizers, and other rotating downhole tools. In one aspect, the movable members 260 may be associated with the lateral extents of the bit body 201. In an exemplary embodiment, moveable gage pads 260 are extended relative to the bit body 201 for drill bit stability. In certain embodiments, when extended moveable gage pads 260 are extended beyond the cutters 238 (overgage). In other embodiments, extended movable gage pads 260 do not extend beyond the cutters 238 (undergage) but are still extended more than a relative retracted position. In an exemplary embodiment, moveable gage pads 260 are retraced relative to the bit body for decreased friction and increased steering capability. In certain embodiments, when retracted moveable gage pads 260 are retracted they are undergage, and are retracted further toward bit body 201 than the extended gage pads. In an exemplary embodiment, the moveable members 260 are disposed adjacent to the static gage pads 234 to augment or enhance the characteristics of the static gage pads 234. In certain embodiments, the moveable members 260 are utilized without static gage pads 234. In an exemplary embodiment, moveable members 260 are disposed on a sleeve 290 that allows moveable members 260 to remain stationary while drill bit 200 rotates. Referring to FIG. 2B, a plan view of drill bit 200 with sleeve 290 is shown. In an exemplary embodiment, as drill bit 200 rotates, sleeve 290 remains static by allowing sliding along bearing surface 291. Bearing surface 291 may be any suitable surface to reduce friction and allow sleeve 290 to remain stationary while drill bit 200 rotates. Advantageously, moveable members 260 interact with the formation, as drill bit 200 rotates, without similarly rotating. In certain embodiments, the use of sleeve 290 allows for moveable members 260 and rate control devices 270 to more effectively maintain desired contact with the formation to perform the self adjusting functionality described herein without rotating to an alternate rotational orientation within the formation or wellbore.

In exemplary embodiments, by placing the moveable members 260 near the lateral extents of the bit body 201 the effective extension and retraction of the gage pads can be changed, increasing the stability or decreasing the frictional torque of the bit 200.

As may be appreciated, movable member 260*b* may be extended to any location between the retracted location and the fully extended location by a device in the drill bit 200 such as actuator 270. In an exemplary embodiment, actuator 270 is a rate control device 270.

An activation device 270 may be coupled to the moveable gage pad 260 to extend and retract the moveable gage pad 260 from a drill bit surface location 252. In one aspect, the activation device 270 controls the rate of extension and retraction of the moveable gage pad 260. In another aspect, the device 270 extends the moveable gage pad 260 at a first rate and retracts the moveable gage pad 260 at a second rate. In embodiments, the first rate and second rate may be the same or different rates. In another aspect, the rate of extension of the moveable gage pad 260 may be greater than the rate of retraction. As noted above, the device 270 also is referred to herein as a "rate control device" or a "rate controller." In the particular embodiment of the device 270, the moveable gage pad 260 is directly coupled to the device 270 via a mechanical connection or connecting member 256. In one aspect, the device 270 includes a chamber 271 that houses a double acting reciprocating member, such as a piston 280, that sealingly divides the chamber 271 into a first chamber 272 and a second chamber 274. Both chambers 272 and 274 are filled with a hydraulic fluid 278 suitable for downhole use, such as oil. A biasing member, such as a spring 284, in the first chamber 272, applies a selected force on the piston 280 to cause it to move outward. Since the piston 280 is connected to the moveable gage pad 260, moving the piston outward causes the moveable gage pad 260 to extend from the surface 252 of the drill bit 200. In one aspect, the chambers 272 and 274 are in fluid communication with each other via a first fluid flow path or flow line 282 and a second fluid flow path or flow line 286. A flow control device, such as a fluid restrictor or check valve 285, placed in the fluid flow line 282, may be utilized to control the rate of flow of the fluid from chamber 274 to chamber 272. Similarly, another flow control device, such as a check valve 287, placed in fluid flow line 286, may be utilized to control the rate of flow of the fluid 278 from chamber 272 to chamber 274. The flow control devices 285 and 287 may be configured at the surface to set the rates of flow through fluid flow lines 282 and 286, respectively. In another aspect, the rates may be set or dynamically adjusted by an active device, such as by controlling fluid flows between the chambers by actively controlled valves. In one aspect, one or both flow control devices 285 and 287 may include a variable control biasing device, such as a spring, to provide a constant flow rate from one chamber to another. Constant fluid flow rate exchange between the chambers 272 and 274 provides a first constant rate for the extension for the piston 280 and a second constant rate for the retraction of the piston 280 and, thus, corresponding constant rates for extension and retraction of the moveable gage pad 260. The size of the flow control lines 282 and 286 along with the setting of their corresponding biasing devices 285 and 287 define the flow rates through lines 282 and 286, respectively, and thus the corresponding rate of extension and retraction of the moveable gage pad 260. In one aspect, the fluid flow line 282 and its corresponding flow control device 285 may be set such that when the drill bit 250 is not in use, i.e., there is no external force being applied onto the moveable gage pad 260, the biasing member 280 will extend the moveable gage pad 260 to the maximum extended position. In one aspect, the flow control line 282 may be configured so that the biasing member 280 extends the moveable gage pad 260 relatively fast or suddenly. When the drill bit is in operation, such as during drilling of a wellbore, the wellbore conditions and formation characteristics cause lateral vibrations or whirl applied to the bit exerts an external force on the moveable gage pad 260. This external force causes the moveable gage pad 260 to apply a force or pressure on the piston 280 and thus on the biasing member 284.

In one aspect, the fluid flow line 286 may be configured to allow relatively slow flow rate of the fluid from chamber 272 into chamber 274, thereby causing the moveable gage pad 260 to retract relatively slowly. As an example, the extension rate of the moveable gage pad 260 may be set so that the moveable gage pad 260 extends from the fully retracted position to a fully extended position over a few seconds while it retracts from the fully extended position to the fully retracted position over one or several minutes or longer (such as between 2-5 minutes). It will be noted, that any suitable rate may be set for the extension and retraction of the moveable gage pad 260. In one aspect, the device 270 is a passive device that adjusts the extension and retraction of a pad based on or in response to the force or pressure applied on the moveable gage pad 260. Advantageously, the drill bit 200 can quickly adapt to expand and mitigate vibrations and slowly retract to decrease friction and increase steering capability as wellbore conditions change. FIG. 2A shows an exemplary drill bit 200 made according to one embodiment of the disclosure, wherein moveable gage pads 260 include a pivot 299. In an exemplary embodiment, pivot 299 allows moveable gage pad 260 to rotate about a pivot 299 as device 270 actuates the gage pad 260. Advantageously, allowing a moveable member to pivot about a pivot axis allows for increased stability when moveable members such as gage pads are extended, while increasing steerability when the moveable members are retracted.

Figure 3:
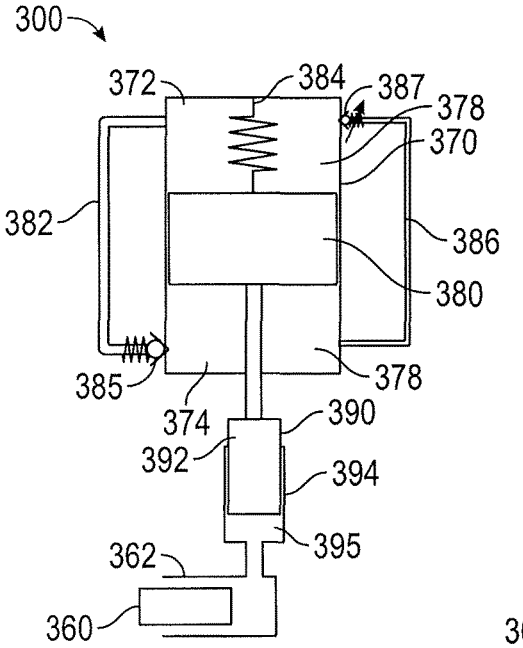
FIG. 3 shows an alternative embodiment of the rate control device that operates the moveable member via a hydraulic line.

FIG. 3 shows an alternative rate control device 300. The device 300 includes a fluid chamber 370 divided by a double acting piston 380 into a first chamber 372 and a second chamber 374. The chambers 372 and 374 are filled with a hydraulic fluid 378. A first fluid flow line 382 and an associated flow control device 385 allow the fluid 378 to flow from chamber 374 to chamber 372 at a first flow rate and a fluid flow line 386 and an associated flow control device 387 allow the fluid 378 to flow from the chamber 372 to chamber 374 at a second rate. The piston 380 is connected to a force transfer device 390 that includes a piston 392 in a chamber 394. The chamber 394 contains a hydraulic fluid 395, which is in fluid communication with a moveable gage pad 360. In one aspect, the moveable gage pad 360 may be placed in a chamber 352, which chamber is in fluid communication with the fluid 395 in chamber 394. When the biasing device 384 moves the piston 380 outward, it moves the piston 392 outward and into the chamber 394. Piston 392 expels fluid 395 from chamber 394 into the chamber 352, which extends the moveable gage pad 360. When a force is applied on to the moveable gage pad 360, it pushes the fluid in chamber 352 into chamber 394, which applies a force onto the piston 380. The rate of the movement of the piston 380 is controlled by the flow of the fluid through the fluid flow line 386 and flow control device 387. In the particular configuration shown in FIG. 3, the rate control device 300 is not directly connected to the moveable gage pad 360, which enables isolation of the device 300 from the moveable gage pad 360 and allows it to be located at any desired location in the drill bit.

Figure 4:
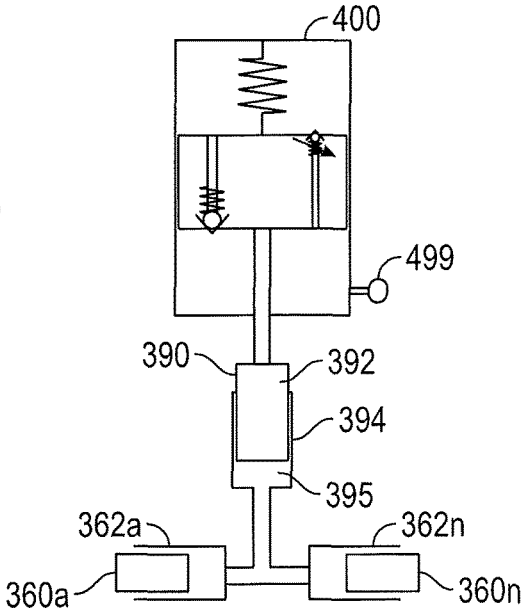
FIG. 4 shows an embodiment of a rate control device configured to operate multiple moveable members.

FIG. 4 shows a common rate control device 400 configured to operate more than one pad, such as moveable gage pads 360*a*, 360*n*. The rate control device 400 is the same as shown and described in FIG. 2, except that it is shown to apply force onto the moveable gage pads 360*a*, 360*n* via an intermediate device 390, as shown and described in reference to FIG. 3. In the embodiment of FIG. 4, each of the moveable gage pads 360*a*, 360*n* is housed in separate chambers 362*a*, 362*n* respectively. The fluid 395 from chamber 394 is supplied to all chambers, thereby automatically and simultaneously extending and retracting each of the moveable gage pads 360*a*, 360*n* based on external forces applied to each such moveable gage pads during drilling. In aspects, the rate control device 400 may include a suitable pressure compensator 499 for downhole use. Similarly any of the rate controllers made according to any of the embodiments may employ a suitable pressure compensator.

Therefore in one aspect, a drill bit is disclosed, including: a bit body; and at least one moveable member associated with a lateral extent of the bit body that extends from the lateral extent of the bit body at a first rate and retracts from an extended position to a retracted position at a second rate that is less than the first rate.

In certain embodiments, the drill bit further includes a rate control device coupled to the at least one moveable member that extends the at least one moveable member at the first rate and retracts the at least one moveable member at the second rate in response to external force applied onto the at least one moveable member. In certain embodiments, the rate control device includes: a piston for applying a force on the at least one moveable member; and a biasing member that applies a force on the piston to extend the at least one moveable member at the first rate. In certain embodiments, the rate control device is self-adjusting. In certain embodiments, the drill bit further includes a fluid chamber divided by the piston into a first fluid chamber and a second fluid chamber; and a first fluid flow path from the first fluid chamber to the second fluid chamber that controls movement of the piston in a first direction at the first rate and a second fluid flow path from the second chamber to the first chamber that controls movement of the piston in a second direction at the second rate. In certain embodiments, a first flow control device in the first fluid flow path defines the first rate and a second flow control device in the second fluid flow path defines the second rate. In certain embodiments, at least one of the first rate and the second rate is a constant rate. In certain embodiments, the piston is operatively coupled to the at least one moveable member by one of: a direct mechanical connection; and via a fluid. In certain embodiments, the rate control device includes a double acting piston operatively coupled to the at least one moveable member, wherein a fluid acting on a first side of the piston controls at least in part the first rate and a fluid acting on a second side of the piston controls at least in part the second rate. In certain embodiments, a non-rotating sleeve is associated with the at least one moveable member. In certain embodiments, the at least one moveable member moves about a pivot associated with the bit body.

In another aspect, a method of drilling a wellbore is disclosed, including: providing a drill bit including a bit body and at least one movable member associated with a lateral extent of the bit body; conveying a drill string into a formation, the drill string having the drill bit at the end thereof; drilling the wellbore using the drill string; selectively extending the at least one moveable member from the lateral extent of the bit body at a first rate; and selectively retracting the at least one moveable member to a retracted position at a second rate that is less than the first rate. In certain embodiments, the method further includes a rate control device coupled to the at least one moveable member that extends the at least one moveable member at the first rate and retracts the at least one moveable member at the second rate in response to external force applied onto the at least one moveable member. In certain embodiments, the rate control device includes: a piston for applying a force on the at least one moveable member; and a biasing member that applies a force on the piston to extend the at least one moveable member at the first rate. In certain embodiments, the drill bit further includes: a fluid chamber divided by the piston into a first fluid chamber and a second fluid chamber; and a first fluid flow path from the first fluid chamber to the second fluid chamber that controls movement of the piston in a first direction at the first rate and a second fluid flow path from the second chamber to the first chamber that controls movement of the piston in a second direction at the second rate. In certain embodiments, a first flow control device in the first fluid flow path defines the first rate and a second flow control device in the second fluid flow path defines the second rate. In certain embodiments, a non-rotating sleeve is associated with the at least one moveable member. In certain embodiments, the at least one moveable member moves about a pivot associated with the bit body.

In another aspect, a system for drilling a wellbore is disclosed, including: a drilling assembly having a drill bit, the drill bit including: a bit body; and at least one moveable member associated with a lateral extent of the bit body that extends from the lateral extent of the bit body at a first rate and retracts from an extended position to a retracted position at a second rate that is less than the first rate. In certain embodiments, the system further includes a rate control device coupled to the at least one moveable member that extends the at least one moveable member at the first rate and retracts the at least one moveable member at the second rate in response to external force applied onto the at least one moveable member. In certain embodiments, the rate control device includes: a piston for applying a force on the at least one moveable member; and a biasing member that applies a force on the piston to extend the at least one moveable member at the first rate. In certain embodiments, the system further includes a fluid chamber divided by the piston into a first fluid chamber and a second fluid chamber; and a first fluid flow path from the first fluid chamber to the second fluid chamber that controls movement of the piston in a first direction at the first rate and a second fluid flow path from the second chamber to the first chamber that controls movement of the piston in a second direction at the second rate. In certain embodiments, a first flow control device in the first fluid flow path defines the first rate and a second flow control device in the second fluid flow path defines the second rate. In certain embodiments, the rate control device includes a double acting piston operatively coupled to the at least one moveable member, wherein a fluid acting on a first side of the piston controls at least in part the first rate and a fluid acting on a second side of the piston controls at least in part the second rate. In certain embodiments, a non-rotating sleeve is associated with the at least one moveable member. In certain embodiments, the at least one moveable member moves about a pivot associated with the bit body.

The invention claimed is:

1. A drill bit, comprising:

a bit body; and at least one self-adjusting moveable member associated with a lateral extent of the bit body that extends from the lateral extent of the bit body at a first rate to reduce vibration and retracts from an extended position to a retracted position at a second rate that is less than the first rate to decrease friction and increase maneuverability, wherein the first rate corresponds to a first flow rate provided by a first fluid flow path and the second rate corresponds to a second flow rate provided by a second fluid flow path.

2. The drill bit of claim 1 further comprising a rate control device coupled to the at least one moveable member that extends the at least one moveable member at the first rate and retracts the at least one moveable member at the second rate in response to external force applied onto the at least one moveable member.

3. The drill bit of claim 2, wherein the rate control device includes:

a piston for applying a force on the at least one moveable member; and a biasing member that applies a force on the piston to extend the at least one moveable member at the first rate.

4. The drill bit of claim 3, wherein the rate control device is self-adjusting.

5. The drill bit of claim 3, further comprising:

a fluid chamber divided by the piston into a first fluid chamber and a second fluid chamber; and wherein the first fluid flow path fluidly couples the first fluid chamber to the second fluid chamber that controls movement of the piston in a first direction at the first rate and the second fluid flow path fluidly couples the second chamber to the first chamber that controls movement of the piston in a second direction at the second rate.

6. The drill bit of claim 5, wherein a first flow control device in the first fluid flow path defines the first rate and a second flow control device in the second fluid flow path defines the second rate.

7. The drill bit of claim 2, wherein the piston is operatively coupled to the at least one moveable member by one of: a direct mechanical connection; and via a fluid.

8. The drill bit of claim 2, wherein the rate control device includes a double acting piston operatively coupled to the at least one moveable member, wherein a fluid acting on a first side of the piston controls at least in part the first rate and a fluid acting on a second side of the piston controls at least in part the second rate.

9. The drill bit of claim 1, wherein at least one of the first rate and the second rate is a constant rate.

10. The drill bit of claim 1, further including a non-rotating sleeve associated with the at least one moveable member.

11. The drill bit of claim 1, wherein the at least one moveable member moves about a pivot associated with the bit body.

12. A method of drilling a wellbore, comprising:

providing a drill bit including a bit body and at least one self-adjusting movable member associated with a lateral extent of the bit body;

conveying a drill string into a formation, the drill string having the drill bit at the end thereof;

drilling the wellbore using the drill string;

selectively extending the at least one moveable member from the lateral extent of the bit body at a first rate to reduce vibration; and selectively retracting the at least one moveable member to a retracted position at a second rate that is less than the first rate to decrease friction and increase maneuverability, wherein the first rate corresponds to a first flow rate provided by a first fluid flow path and the second rate corresponds to a second flow rate provided by a second fluid flow path.

13. The method of claim 12, wherein the drill bit further includes a rate control device coupled to the at least one moveable member that extends the at least one moveable member at the first rate and retracts the at least one moveable member at the second rate in response to external force applied onto the at least one moveable member.

14. The method of claim 13, wherein the rate control device includes:

a piston for applying a force on the at least one moveable member; and a biasing member that applies a force on the piston to extend the at least one moveable member at the first rate.

15. The method of claim 14, wherein the drill bit further includes:

a fluid chamber divided by the piston into a first fluid chamber and a second fluid chamber; and wherein the first fluid flow path fluidly couples the first fluid chamber to the second fluid chamber that controls movement of the piston in a first direction at the first rate and the second fluid flow path fluidly couples the second chamber to the first chamber that controls movement of the piston in a second direction at the second rate.

16. The method of claim 12, wherein a first flow control device in the first fluid flow path defines the first rate and a second flow control device in the second fluid flow path defines the second rate.

17. The method of claim 12, wherein a non-rotating sleeve is associated with the at least one moveable member.

18. The method of claim 12, wherein the at least one moveable member moves about a pivot associated with the bit body.

19. A system for drilling a wellbore, comprising:

a drilling assembly having a drill bit, the drill bit including:

a bit body; and at least one self-adjusting moveable member associated with a lateral extent of the bit body that extends from the lateral extent of the bit body at a first rate to reduce vibration and retracts from an extended position to a retracted position at a second rate that is less than the first rate to decrease friction and increase maneuverability, wherein the first rate corresponds to a first flow rate provided by a first fluid flow path and the second rate corresponds to a second flow rate provided by a second fluid flow path.

20. The system of claim 19 further comprising a rate control device coupled to the at least one moveable member that extends the at least one moveable member at the first rate and retracts the at least one moveable member at the second rate in response to external force applied onto the at least one moveable member.

21. The system of claim 20, wherein the rate control device includes:

a piston for applying a force on the at least one moveable member; and a biasing member that applies a force on the piston to extend the at least one moveable member at the first rate.

22. The system of claim 21, further comprising:

a fluid chamber divided by the piston into a first fluid chamber and a second fluid chamber; and wherein the first fluid flow path fluidly couples the first fluid chamber to the second fluid chamber that controls movement of the piston in a first direction at the first rate and the second fluid flow path fluidly couples the second chamber to the first chamber that controls movement of the piston in a second direction at the second rate.

23. The system of claim 22, wherein a first flow control device in the first fluid flow path defines the first rate and a second flow control device in the second fluid flow path defines the second rate.

24. The system of claim 20, wherein the rate control device includes a double acting piston operatively coupled to the at least one moveable member, wherein a fluid acting on a first side of the piston controls at least in part the first rate and a fluid acting on a second side of the piston controls at least in part the second rate.

25. The system of claim 19, further including a non-rotating sleeve associated with the at least one moveable member.

26. The system of claim 19, wherein the at least one moveable member moves about a pivot associated with the bit body.

* * * * *